United States Patent [19]

Beckett et al.

[11] Patent Number: 4,905,383

[45] Date of Patent: Mar. 6, 1990

[54] DIFFERENTIALLY RESPONSIVE SOLE FOR SHOES

[76] Inventors: Donald E. Beckett, 16110 Foxfire Dr., Tampa, Fla. 33618; Joseph A. Carolfi, 901 Maple Ave., Collingswood, N.J. 08108

[21] Appl. No.: 259,528

[22] Filed: Oct. 18, 1988

[51] Int. Cl.[4] ..... A43B 13/18; A43B 13/40; A43B 13/14

[52] U.S. Cl. ..... 36/28; 36/30 A; 36/44; 36/88; 128/581

[58] Field of Search ..... 36/30 A, 28, 43, 44, 36/30 R, 32 R, 88; 128/581, 614, 615, 586, 595

[56] References Cited

U.S. PATENT DOCUMENTS

| | | | |
|---|---|---|---|
| 2,677,906 | 5/1954 | Reed | 36/28 X |
| 2,863,231 | 12/1958 | Jones | 128/615 |
| 4,229,889 | 10/1980 | Petrosky | 36/43 X |
| 4,408,402 | 10/1983 | Looney | 36/43 |
| 4,471,538 | 9/1984 | Pomeranz | 36/28 |
| 4,633,877 | 1/1987 | Pendergast | 128/581 |
| 4,744,157 | 5/1988 | Dubner | 36/44 X |
| 4,760,655 | 8/1988 | Mauch | 36/44 |

FOREIGN PATENT DOCUMENTS

| | | | |
|---|---|---|---|
| 3627538 | 2/1988 | Fed. Rep. of Germany | 36/43 |
| 3639505 | 6/1988 | Fed. Rep. of Germany | 36/43 |
| 104732 | 9/1964 | Norway | 36/43 |

*Primary Examiner*—James Kee Chi

*Attorney, Agent, or Firm*—Z. T. Wobensmith, III

[57] ABSTRACT

A differentially responsive sole for shoes is disclosed which includes a conventional outer sole, an inner sole and an inner liner, the inner sole having a plurality of empty chambers located to support biomechanical weight bearing pressure prints for which a norm has been established. Measurements are made of the individual user at the points and the chambers filled with an elastomer of certain durometer and compressive strength to compensate for the weight load at each weight bearing pressure point.

4 Claims, 2 Drawing Sheets

DIFFERENTIALLY RESPONSIVE SOLE FOR SHOES

BACKGROUND OF THE INVENTION

1. Field of the Invention

This invention relates to a differentially responsive sole of the type with chambers to be filled with material to provide for individual out of normal weight distribution among weight bearing pressure points.

2. Description of the Prior Art

With the increase in running and walking marathons where competition is high, there has been considerable interest in improving footwear, and in tailoring it to an individual's particular weight bearing abnormalities. Many cushions and other devices have been proposed as described in the following U.S. patents to Wolstenholme et al., No. 3,892,077, Zente, No. 3,922,801, Turner et al., No. 4,364,188, Batra, No. 4,398,357, Meyers, No. 4,445,283, and Oatman, No. 4,658,515. While some of these structures provide a degree of cushioning for the user's feet, none of them provide for adequate compensation that is designed to satisfy the needs of an individual's particular foot weight bearing problems, and to accommodate or correct these problems using reproducible data.

During the past decade developments in sensory devices have provided researchers with new diagnostic information about the way people use their feet during ambulation. Some of this information can be used to illustrate how a person distributes, percentages of his or her body weight among selected Biomechanical Weight Bearing Pressure Points (B.W.B.P.P.) of the feet during ambulation. A normal distribution amongst the B.W.B.P.P) has been determined, and minor variations from these norms have been known to cause discomfort and problems both muscular and orthopedic. The resultant problems can occur in the foot, the leg, and even in the hips and lower spine.

The sole of the invention cushions the foot at selected locations where a person is overloading a point and stiffens where a person is underloading a point, the sole therefore providing for customizing to an individual's weight distribution pattern.

SUMMARY OF THE INVENTION

The sole of the invention includes a plurality of stragetically located empty chambers that are filled with an elastomer whose hardness and compressive strength, is determined by measuring selected biomechanical weight bearing pressure points (B.W.B.P.P.), and determining individual point values, so that the characteristics of the material for each of the individual points is determined and can then be formulated and placed into the chambers to provide an optimum sole response.

The principal object of the invention is to provide a differentially responsive sole for shoes that is tailored to the individuals particular measured load placing peculiarities for selected locations of feet.

A further object of the invention is to provide a sole of the character aforesaid which is simple and inexpensive to construct but durable and long lasting in use.

A further object of the invention is to provide a sole of the character aforesaid that should improve the users running and walking capabilities.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
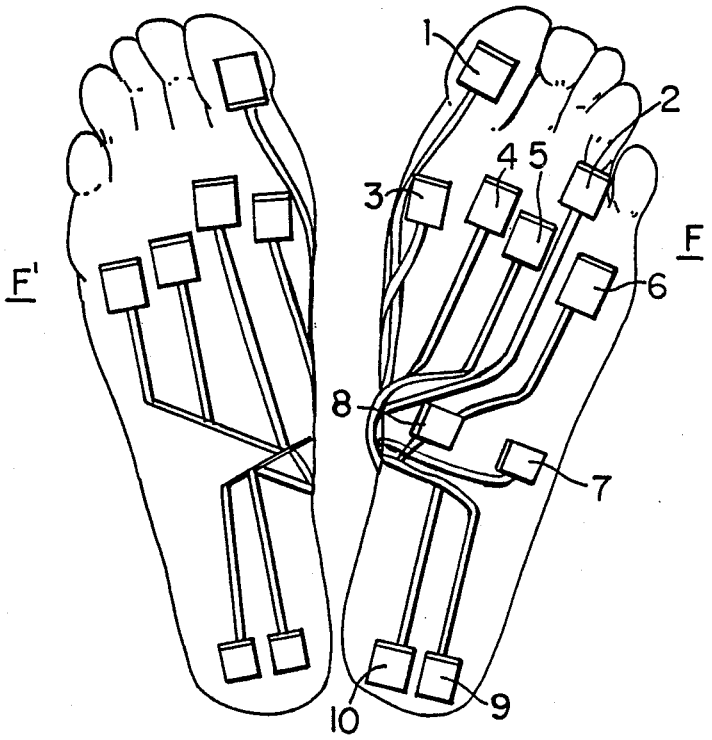
FIG. 1 is a bottom plan view of a typical individual's feet illustrating ten weight bearing points to be measured.
Figure 2:
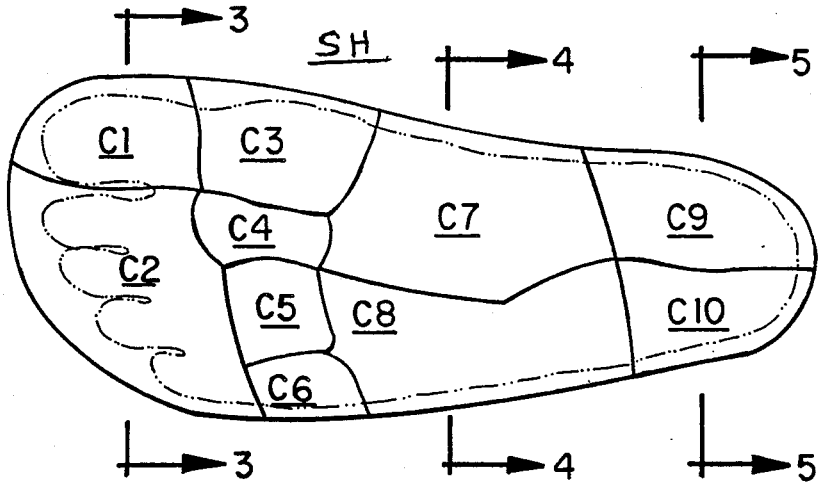
FIG. 2 is a bottom plan view of the sole of the invention.
Figure 3:
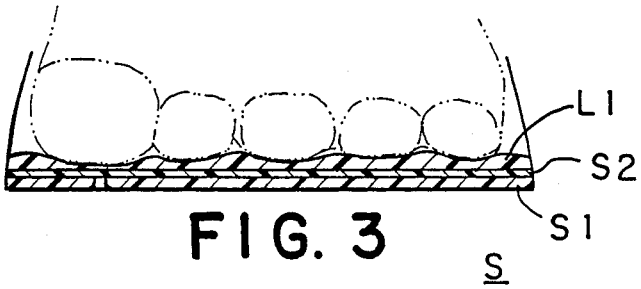
FIG. 3 is a vertical sectional view enlarged taken approximately on line 3—3 of FIG. 1.
Figure 4:
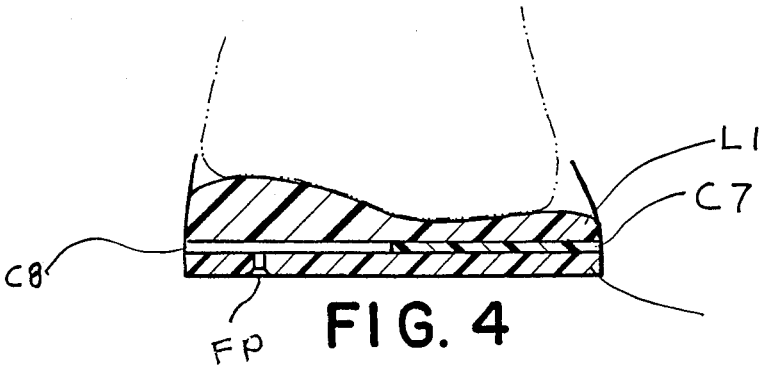
FIG. 4 is a vertical sectional view enlarged taken approximately on the line 4—4 of FIG. 1.
Figure 5:
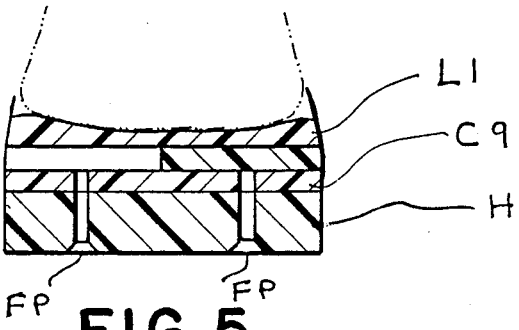
FIG. 5 is a vertical sectional view enlarged taken approximately on the line 5—5 of FIG. 1.

Referring now more particularly to the drawings and FIGS. 1 to 5 inclusive in FIG. 1 a typical individual's feet F and F' are illustrated with ten chambers where individual weight bearing points will be determined. A shoe SH is shown in fragmentary form which includes a sole S, two layers, S1 which is the outer sole, S2 which is the inner sole, and an inner liner L1. The outer sole S1 is of conventional configuration and the inner sole S2 has the ten chambers located in it as described below. The shoe SH also includes a heel H as shown in FIG. 5 and fill points FP for the chambers to be described. More or less chambers can be used as desired however it has been determined that ten stragetically located chambers provide the necessary support for most uses. These ten chambers are:

C1 Hallux
C2 Digits
C3 1st Metatarsal
C4 2nd Metatarsal
C5 3rd and 4th Metatarsal
C6 5th Metatarsal
C7 medial Arch
C8 Lateral Arch
C9 Medial Heel
C10 Lateral Heel The normal at peak load for these areas are:

C1 20% of Body WEight
C2 Neutral
C3 12% of Body Weight
C4 20% of Body Weight
C5 14% of Body Weight
C6 8% of Body WEight
C7 Neutral
C8 Neutral
C9 16% of Body Weight
C10 16% of Body Weight These norms have been selected for standard dress shoes under walking conditions. A different set of norms are used for each type of shoe and the predominant mode of ambulation (walking, jogging, running, etc.). In addition, three neutral chambers are included in this example, which will be filled with an elastomer at the mean compressive strength. The mean compressive strength is determined by considering the type of shoe, the mode of amublation, and the user's body weight. These neutral chambers are important for filling all areas of the sole, forming a custom arch support and may become active if a person's pathology causes these areas to become weight bearing.

The assumptions used in determining an individual foot profile as described below are based on existing materials and data gathering equipment. Many other systems and materials are available and these assumptions are in no way restrictive or the only means to make the sole useful. The elastomer is available from Polytech Corp., P.O. Box 384, Lebanon, N.J. 08833, and the data gathering device is available from The Langer Biomechanical Group, Inc., 21 EAst Industry Court, Deer Park, New York 11729.

THE ELASTOMER

1. The elastomer (E) is a type which is modifiable in its compressive strength (D) by the addition of a plasticizer and/or a foaming agent (P) at manufacturing.
2. The elastomer without modification has a set hardness of 55 Shore A Durameter.
3. For each 400 parts of the elastomer the addition of 1 each part of the modifier P will have the effect of reducing the compressive strength to cushion 1 pound per square inch more of pressure at peak compression.
4. Since the mean compressive strength of the elastomer will require a certain amount of P for normal, the reverse is also true. The lowering of each 1 part of P will stiffen the elastomer to resist 1 pound per square inch more of pressure at peak compression.
5. These changes in compressive strength are all relative to the mean compressive strength.
6. The unmodified compressive strength (ID) will cushion 100 pounds per square inch.

THE DATA

1. A data source should be available to analyze the foot strike of an individual corresponding to the chambers (c) of the sole.
2. The data will be representative of the type of ambulation that the sole will be used for.
3. The data will be formatted as a percent of total body weight (PW) plus or minus the norm for that specific weight (B.).
4. Neutral chambers will have no data unless required.

DETERMINATION OF THE MEAN COMPRESSIVE STRENGTH

The mean compressive strength (D) is determined by considering the shoe type (ST) that the sole will be used in (i.e. dress shoe, running shoe, etc.) and the body weight of the user (W).

$$D=W*ST$$

ST is a factor to set the largest percent of body weight PW) that the sole would undergo while in use. Each type of use (running, walking, dancing, tennis, etc.) has its own maximum percent of body weight stress and it also has a unique percentage distribution pattern amongst the chambers of the sole.

The W factor is to establish the best compessive strength for the normal weight, while allowing enough range of modification in the elastomer to compensate for out of normal weight readings.

The formulas for mixing the mean compressive strength elastomer is as follows.

$$P(D)=ID-D$$

$$D=E+P(D)$$

DETERMINATION OF COMPRESSIVE STRENGTH FOR EACH CHAMBER

The following formula is used to establish the compressive strength for any chamber.

$$D(C)=E+P(D)+(P*(W*PW)$$

Measurements were made of a typical individual as follows:

EXAMPLE

Subject: male
Body weight: 187 pounds
Shoe type: casual shoe
Shoe use: walking

| | DATA | | |
|---|---|---|---|
| | Peak force | Normal | Out |
| | | Left foot: | |
| 1 | 12% B.W. | 20% B.W. | −8% |
| 2 | neutral | | |
| 3 | 18% B.W. | 12% B.W. | +6% |
| 4 | 23% B.W. | 20% B.W. | +3% |
| 5 | 16% B.W. | 14% B.W. | +2% |
| 6 | 14% B.W. | 8% B.W. | +6% |
| 7 | neutral | | |
| 8 | neutral | | |
| 9 | 15% B.W. | 16% B.W. | −1% |
| 10 | 13% B.W. | 16% B.W. | −3% |
| | | Right foot: | |
| 1 | 16% B.W. | 20% B.W. | −4% |
| 2 | neutral | | |
| 3 | 14% B.W. | 12% B.W. | +2% |
| 4 | 20% B.W. | 20% B.W. | 0% |
| 5. | 14% B.W. | 14% B.W. | 0% |
| 6 | 11% B.W. | 8% B.W. | +3% |
| 7. | neutral | | |
| 8. | neutral | | |
| 9 | 14% B.W. | 16% B.W. | −2% |
| 10 | 15% B.W. | 16% B.W. | −1% |

The data was obtained by using the well known Langer measuring equipment, however it is expected that other such equipment would also provide useful data from which suitable soles could be constructed.

Mean

ST=0.35
D=187*0.35
D=65.5 lbs/sq inch

AMOUNT OF P FOR MEAN

ID=100 lbs/sq. inch
P(D)=100−65.5
P(D)=34.5

MEAN FILLER

The cushioning needed for D is obtained by adding 34.5 parts [P(D)] to every 400 parts of E $$D=E+[P(D)*[E/400]]$$

So for 600 grams of E $$34.5*600/400=51.75$$

You would add 51.75 grams of P

CHAMBER FILLER

The cushioning needed for a chamber D(C) is obtained by multiplying the out of norm load (PW) (plus or minus) by the total weight (W). Then multiplying that result by the parts of P needed per pound per sq. inch cushioning. Then adding that to the mean P(D).

$$D(C)=E+[P(D)*[E/400]]+[[P*CW*PW]]*[E/400]]$$

APPLICATION TO TEST CASE

Each batch will have a 600 gram amount of E. Also a ratio of 1 part P to modify 400 parts E by 1 lb. per sq. inch of cushioning. Results will be rounded to the nearest hundredth gram. Neutral chambers will be filled with mean compressive strength elastomer.

| chamber | E batch | Total P |
|---|---|---|
| | Left foot | |
| 1 | 600 gr | 29.31 gr |
| 2 | 600 gr | 51.75 gr |
| 3 | 600 gr | 78.58 gr |
| 4 | 600 gr | 60.17 gr |
| 5 | 600 gr | 57.36 gr |
| 6 | 600 gr | 78.58 gr |
| 7 | 600 gr | 51.75 gr |
| 8 | 600 gr | 51.75 gr |
| 9 | 600 gr | 48.94 gr |
| 10 | 600 gr | 43.33 gr |
| | Right foot | |
| 1 | 600 gr | 40.08 gr |
| 2 | 600 gr | 51.75 gr |
| 3. | 600 gr | 57.36 gr |
| 4 | 600 gr | 60.17 gr |
| 5 | 600 gr | 51.75 gr |
| 6 | 600 gr | 60.17 gr |

-continued

| chamber | E batch | Total P |
|---|---|---|
| 7 | 600 gr | 51.75 gr |
| 8 | 600 gr | 46.14 gr |
| 10 | 600 gr | 48.94 gr |

Construction of the soles with the described material in the identified chambers resulted in soles which compensated for the user's weight bearing pattern. While the tests were conducted for a walking shoe, tests for athletic and other special purpose shoes can be expected to develop useful data which can be used to manufacture soles for use in such shoes.

It will thus be seen that soles have been provided with which the objects of the invention are achieved.

We claim:

1. An integral shoe for shoes that is differentally responsive to provide a selected response at each of a plurality of selected location to be determined on an individual basis which comprises a plurality of hollow chambers in said sole at selected weight bearing pressure points, means for determining the characteristics of the desired response at each of the selected points, wherein said response at each of the selected points is measured for each foot and compared to the normal expected weight at that location and the response to meet the measured weight is determined to correct for differences from the normal expected weight, and pressure supporting and responsive material filling all of said chambers, to provide the desired response at the weight bearing pressure points.

2. A sole as defined in claim 1 in which said chambers are each provided with injector points and said material is injected into said chambers.

3. A sole as defined in claim 2 in which said material is compounded for each selected weight bearing pressure point to provide the desired response.

4. A sole as defined in claim 1 in which said material is an elastomer.

* * * * *